United States Patent [19]

Loyd

[11] 4,028,705

[45] June 7, 1977

[54] REMOVABLE ANTENNA MOUNT

[76] Inventor: J. Leslie Loyd, 1524 Elm Ave., S. Pittsburg, Tenn. 37380

[22] Filed: Apr. 29, 1976

[21] Appl. No.: 681,861

[52] U.S. Cl. ..... 343/715; 248/223.4; 248/535; 248/224.3; 248/231.1

[51] Int. Cl.[2] ..... H01Q 1/32

[58] Field of Search ..... 343/711, 713, 715; 248/223, 535

[56] References Cited

UNITED STATES PATENTS 3,544,140 12/1970 Langheck ..... 343/715

3,729,741 4/1973 Otto ..... 343/713

FOREIGN PATENTS OR APPLICATIONS 1,200,425 12/1959 France ..... 343/715

*Primary Examiner*—Eli Lieberman

*Attorney, Agent, or Firm*—A. Yates Dowell Jr.

[57] ABSTRACT

Apparatus for removably mounting a communications antenna on a vehicle in such a manner that the antenna is fully exposed when the vehicle is in use but may be removed and stored out of sight when the vehicle is not in use.

3 Claims, 4 Drawing Figures

REMOVABLE ANTENNA MOUNT

BACKGROUND OF THE INVENTION

1. Field of the Invention.

This invention relates generally to structures which can be moved from an operative position to an inoperative position, and relates specifically to radio antennas which are mounted on a vehicle when in use but may be easily removed and stored when not in use.

2. Description of the Prior Art.

In the past, many vehicles such as motor vehicles, boats, and planes have been provided with radios for communications, entertainment and the like and each of these radios has required an antenna for the reception of a signal. Ordinarily, an antenna is fixed to the vehicle and remains in position regardless of whether the vehicle is in use or not. Occasionaly, conventional AM-FM radio antennas are broken as an act of vandalism when the vehicle is not in use.

In recent years, special communication equipment, such as two-way radios which operate on fixed frequencies or citizen band radios which operate on a plurality of frequencies or channels, has become popular since the operator can transmit a signal as well as receive a signal. These radios and other communication equipment have proved to be helpful in summoning aid in case of emergency, reporting accidents, obtaining traffic information and the like, and, although the equipment has been relatively expensive, the additional information which can be obtained has been worth the expense. Since this type of communication equipment is expensive, relatively small, and can be easily disposed of, such equipment has had a high rate of theft. In most cases, the sending and transmitting apparatus may be installed in an unobtrusive position within the vehicle which cannot be seen easily from the exterior. However, this type of equipment normally requires a special antenna located exteriorly of the vehicle which is used for transmitting as well as receiving a signal. Since the antenna is distinctive, thieves have recognized that the vehicle is equipped with relatively expensive communication equipment such as a CB radio or the like and have broken into the vehicle to steal such equipment.

Some efforts have been made to provide special antennas which are not easily recognizable; however, these efforts have not been successful since the body of the vehicle has interfered with the transmission of a signal unless the antenna was well clear of the body. Additional attempts have been made to provide an antenna mount which can be removed when the vehicle is not in use; however, these attempts have not met with success since the antenna has required a substantially rigid mount in order to withstand vibrations and air pressure when the vehicle is in use.

Some examples of prior art structures are U.S. Pat. Nos. 3,071,338 to Kaufman et al; 3,169,739 to Yacobian; 3,369,247 to Bacow; and 3,555,551 to Gronlund.

SUMMARY OF THE INVENTION

The present invention is embodied in a removable antenna mount having a base which is fixed to the vehicle in a position normally hidden from view, and a body which is slidably connected to the base. The body is provided with a portion that extends to the exterior of the vehicle and the outer end of such body has means for receiving the antenna of a CB or two-way radio. When the antenna is mounted on an automobile or the like, the base preferably is mounted on the well of the trunk or luggage compartment and adjacent to the trunk hinges in a position to be covered by the trunk lid when the trunk is closed. The base normally has one or more channels or passageways in which a portion of the body is slidably received. The inner end of the body is disposed beneath the trunk lid when the lid is closed, and the intermediate portion of the body extends upwardly adjacent to the trunk lid so that the trunk lid locks the body onto the base when the vehicle is in use, and the body and base of the mount are in assembled relationship. When the vehicle is to be left unattended, the trunk lid may be opened after which the body of the mount can be disconnected from the base and the body with the antenna attached may be placed within the trunk of the vehicle so that no evidence of special communication equipment is visible from the exterior of the vehicle.

It is an object of the invention to provide an antenna mount that can be easily applied when the vehicle is to be used and can be easily removed when the vehicle is not in use.

Another object of the invention is to provide a removable antenna mount for a vehicle in which portions of the vehicle lock the mount in assembled relationship when the radio is in use.

DESCRIPTION OF THE PREFERRED EMBODIMENT

Figure 1:
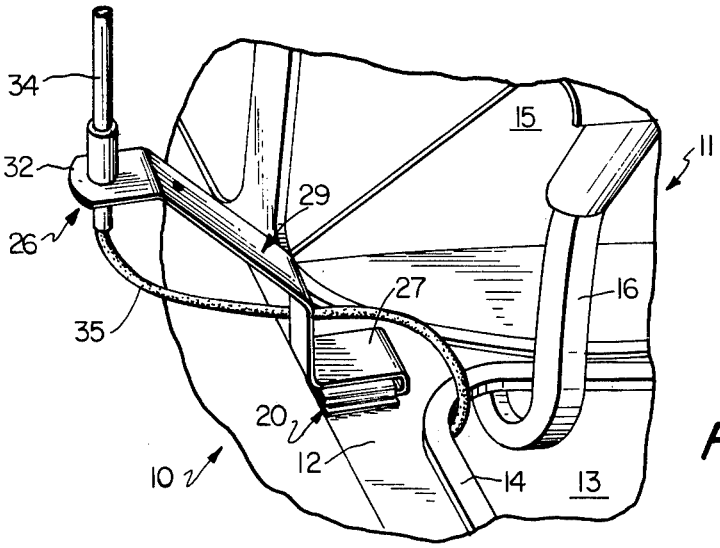
FIG. 1 is a perspective illustrating one application of the invention in use.

With continued reference to the drawing, an automobile 10 or other vehicle is provided with a trunk or luggage compartment 11 of conventional construction. With particular reference to FIG. 1, the rear portion of the automobile is provided with a trunk well 12 having an opening 13 and the periphery of such opening is provided with a relatively large gasket 14 of foam rubber, plastic or other resilient waterproof material. A trunk lid or cover 15 is connected by one or more hinges 16 to the body of the automobile 10 in such a manner that the lid may be raised to provide access to the trunk compartment 11.

Figure 3:
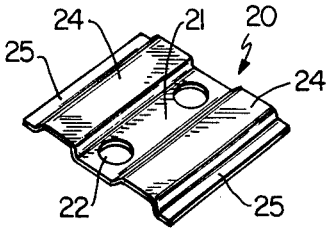
FIG. 3 is a top perspective of the base member of the mount.
Figure 2:
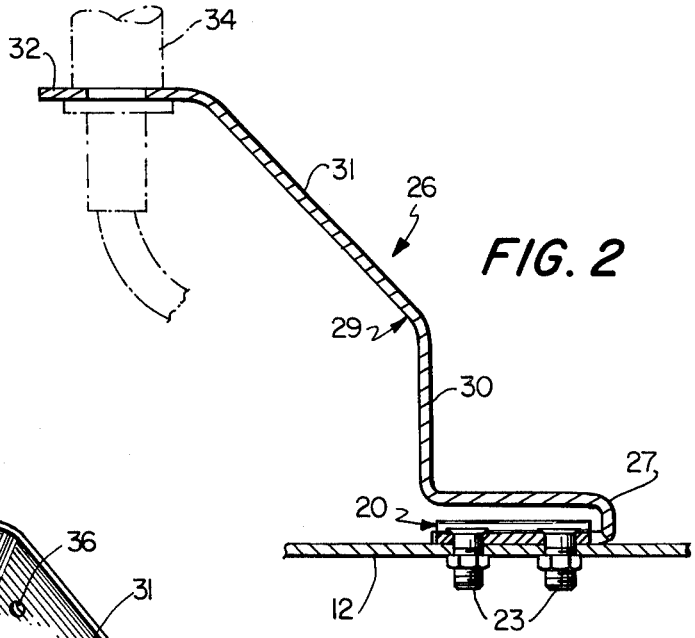
FIG. 2 is an enlarged vertical section of the antenna mount in assembled relationship.
Figure 4:
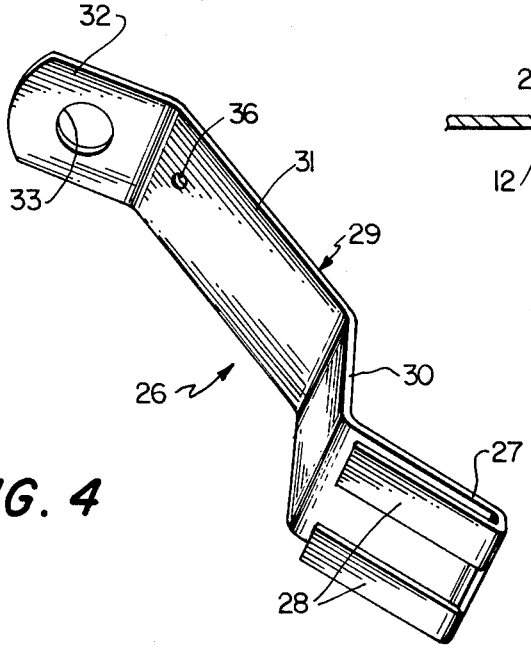
FIG. 4 is a bottom perspective of the body member of the mount.

When it is desired to install special communication equipment, such as a CB radio or the like, in the automobile 10 or other vehicle, the transmitter-receiver or transceiver normally is located within the interior of the vehicle and preferably in a location which cannot be readily seen from the exterior. In order to mount a transmitting and receiving antenna on the vehicle, a base member 20, constructed of sheet metal or the like, is provided (FIG. 3) which includes a central portion 21 having openings 22 for receiving screws or other fasteners 23 by means of which the base member is mounted within the well 12 of the automobile. The base member 20 includes a pair of raised generally parallel portions 24 which define channels or guideways of a particular size. The outer edges 25 of the base member are adapted to intimately engage the well of the automobile to provide a firm support as well as to insure that the base member is grounded to the automobile.

The base member 20 slidably receives a sheet metal body member 26 having a generally U-shaped horizontally disposed portion 27 at its inner end. The lower arm of the U-shaped portion 27 is bifurcated to provide a pair of generally parallel fingers 28 which are selectively received within the channels or guideways of the base. The other arm of the U-shaped portion 27 is integrally connected to an upstanding intermediate portion 29 which includes a generally vertically disposed section 30 and an outwardly inclined arcuate section 31. The upper end of the arcuate section 31 is integrally connected to an outer portion 32 which normally is disposed in spaced generally parallel relationship with the arms of the inner portion 27. The outer portion 32 is provided with an opening 33 normally located along a generally vertical axis in a position to receive a conventional transceiver antenna 34. In order to accommodate most conventional antennas, some body members 26 are produced having an opening 33 which is approximately three eights inch in diameter, while other body members are produced having an opening which is approximately one half inch in diameter.

Most of the commercially available transceiver antennas are of the coaxial type with a shielded housing which intimately engages the outer portion 32 of the body member to provide a ground connection, while the core of the antenna is connected to an insulated antenna lead wire 35 which passes over the gasket 14 into the trunk of the automobile and subsequently is connected to the transceiver unit. Since the gasket 14 is constructed of resilient material, the lead wire 35 is not damaged when the trunk lid 15 is closed. In some commercially available transceiver antennas a separate ground wire is provided and in order to accommodate this type of antenna, an opening 36 is provided in the body member 26 and preferably in the arcuate section 31 thereof so that such ground wire may be connected to the body member 26 by a conventional screw (not shown).

In the operation of the device, the base member 20 is mounted within the well 12 of an automobile trunk or luggage compartment and in a position to be covered by the trunk lid 15 when the lid is closed. When it is desired to operate the transceiver of the communication equipment, the trunk is opened and the fingers 28 are inserted into the channels or guideways of the base member 20 until such fingers are substantially entirely received therein. In this position the fingers 28 preferably slidably engage the lower surface of the raised portions 24 as well as the upper surface of the well 12 to provide a good ground for the body member 26. After the body member is in position, the trunk lid 15 is closed at which time the side edge of the trunk lid passes in close proximity to the vertical section 30 of the intermediate portion 29 and the underneath surface of the trunk lid may engage the upper arm of the U-shaped inner portion 27 when the trunk lid is entirely closed and locked. In this position the trunk lid not only improves the ground connection for the body member 26 but also locks the body member in assembled relationship with the base member 20 since the body member cannot move inwardly toward disengagement.

When the transceiver is not to be used and the vehicle is to be left unattended, it is a simple matter to open the trunk lid and slide the body member 26 inwardly so that the fingers are disengaged from the base member 20 and then the body member wtih the antenna attached thereto may be placed in the trunk compartment after which the trunk lid is closed. In this position there are no visible signs on the exterior of the vehicle indicating that the vehicle is carrying special communications equipment.

Although the antenna mount has been illustrated and described as being mounted on the trunk well of an automobile, it will be apparent that the mounting members could be installed in cooperative relationship with substantially any selectively operable closure member such as a door, hatch, or the like.

I claim:

1. An antenna mount for use with a vehicle having a closure member which can be selectively opened and closed, comprising a substantially flat base member, means for mounting said base member on the vehicle in a fixed position underlying a portion of the closure member, said base member having at least one passageway, a body member selectively connected to said base member, said body member having inner, intermediate and outer portions, said inner portion including at least one finger means of a size to be slidably received within the passageway of said base member, said intermediate portion of said body member being elongated and extending outwardly at an angle to said inner portion for positioning adjacent to the vehicle closure member so that the closure member locks said body member to said base member, and said outer portion of said body member having means for receiving a portion of an antenna, whereby said body member is selectively mounted on said base member in a position to support an antenna exteriorly of the vehicle or said body member may be selectively removed from said base member so that no portion of said antenna mount or the antenna is visible when the closure member is closed.

2. The structure of claim 1 in which said base member has a pair of spaced generally parallel passageways and said body member has a pair of finger means which are selectively cooperatively received within said passageways.

3. A selectively separable antenna mount for mounting a transceiver antenna on an automobile having a trunk lid and a trunk lid well, said antenna mount comprising a base member having a pair of spaced generally parallel passageways, means for mounting said base member within the trunk well of the automobile in a position underlying a portion of the trunk lid, a body member having inner, intermediate and outer portions, said inner portion of said body member being generally U-shaped with substantially parallel arms disposed in horizontal planes, the lower arm being bifurcated for cooperative sliding engagement with the passageways of said base member, the upper arm of said inner portion extending outwardly beyond the trunk lid, said intermediate portion having a section disposed generally vertically and located adjacent to the trunk lid when the trunk lid is closed, said outer portion having an opening of a size to receive a portion of an antenna, whereby when said trunk lid is open said body member may be selectively attached to or removed from said base member and when said body member and base member are in assembled relationship and the trunk lid is closed, the trunk lid locks said body member in assembled relationship with said base member.

* * * * *